United States Patent [19]

Davis, Jr.

[11] Patent Number: 4,704,968

[45] Date of Patent: Nov. 10, 1987

[54] PROJECTILE USING SHAPE-MEMORY ALLOY TO IMPROVE IMPACT ENERGY TRANSFER

[76] Inventor: Thomas O. Davis, Jr., 1950 Camino Redondo, Los Alamos, N. Mex. 87544

[21] Appl. No.: 880,022

[22] Filed: Jun. 30, 1986

[51] Int. Cl.[4] ..... F42B 11/10

[52] U.S. Cl. ..... 102/517; 102/507

[58] Field of Search ..... 102/507, 510, 517, 518, 102/519, 491, 492, 495, 496

[56] References Cited

U.S. PATENT DOCUMENTS

| | | | |
|---|---|---|---|
| 3,173,371 | 3/1965 | Manshel | 102/507 |
| 3,866,536 | 2/1975 | Greenberg | 102/510 |
| 3,956,989 | 5/1976 | Sallade et al. | 102/491 |
| 3,994,752 | 11/1976 | Hayes | 102/494 |
| 4,245,557 | 1/1981 | Knappworst et al. | 102/517 |

OTHER PUBLICATIONS

C. M. Jackson, H. J. Wagner, and R. J. Wasilewski, 55-Nitinol-The Alloy with a Memory, 1972, pp. 77-86.

*Primary Examiner*—Stephen C. Bentley
*Assistant Examiner*—Stephen M. Johnson
*Attorney, Agent, or Firm*—Burns, Doane, Swecker & Mathis

[57] ABSTRACT

A projectile having an active component of shape-memory alloy that will not distort the projectile's shape or balance during launch or flight but which will alter the projectile shape upon impact to increase energy transfer efficiency against targets is disclosed.

13 Claims, 13 Drawing Figures

PROJECTILE USING SHAPE-MEMORY ALLOY TO IMPROVE IMPACT ENERGY TRANSFER

BACKGROUND OF THE INVENTION

The present invention relates to projectiles and, more particularly, to means to improve the impact energy transfer efficiency of projectiles.

Projectiles in the form of conventional bullets remain intact upon striking a soft target to cause substantially a single wound tract. While conventional bullets may expand or tumble after impacting the soft target to increase lethality of the bullet, frequently the bullet will start its expanding or tumbling action only after much of the target has been penetrated. Prior art methods for improving impact energy transfer efficiency and thus bullet lethality generally involve alteration of the external configuration of the bullet, i.e., hollow-point, off-center punch, spoon nose and the like.

U.S. Pat. Nos. 3,173,371, 3,861,314 and 4,338,862 disclose various attempts to alter the performance of a projectile by altering its external configuration to promote instability upon impact or by altering the internal configuration of the projectile with passive elements such as a disc or a low density filler material. Unfortunately, none of prior art devices provides a projectile having positive means to improve the impact energy transfer of the projectile.

SUMMARY OF THE INVENTION

The purpose of the instant invention is to provide a projectile having improved impact energy transfer. To accomplish this purpose there is provided positive means that will not distort the projectile's shape or balance during launch or flight but which will cause the projectile to change shape immediately upon impact in order to increase its energy transfer efficiency against targets. In the case of soft targets this is accomplished by deforming the projectile, thus increasing instability upon impact in order to cause tumbling, or by increasing the projectile's diameter thus increasing its frictional resistance. In the case of hard targets, this is accomplished by deforming the projectile, thus increasing the penetration capability of the projectile. In general, a projectile is provided in accordance with the instant invention wherein the projectile is of shape-memory alloy or having a deforming means of shape-memory alloy which is capable of altering the geometric shape of the projectile upon impact to improve the impact energy transfer of the projectile.

Accordingly, an aspect of the instant invention provides a projectile, comprising:

a core; and deforming means of shape-memory alloy in operative contact with said core, said means capable of altering the geometric shape of said core upon impact of the projectile to improve the impact energy transfer of the projectile.

Another aspect of the invention provides a projectile of shape-memory alloy, said projectile capable of altering in geometric shape upon impact of the projectile to improve the impact energy transfer of the projectile.

Yet another aspect of the invention provides a device of shape-memory alloy wherein said device contains voids, said voids capable of enhancing the speed of recovery of said device by rapidly generating heat due to collapse of the voids when the device is subjected to shock.

DETAILED DESCRIPTION OF THE INVENTION

Figure 1:
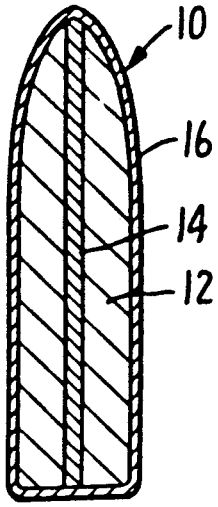
FIG. 1 is a full section view of an embodiment of the instant invention before impact of the projectile.

Projectiles of the instant invention may be made entirely from shape-memory alloy or may utilize a deforming means of shape-memory alloy which is capable of altering the geometric shape of the projectile upon impact to improve the impact energy transfer of the projectile. It is understood that the entire projectile can be made from shape-memory alloy and thus the entire projectile comprises the deforming means within the intended meaning of deforming means. This deforming means is a positive means which will not distort the projectile's shape during launch or flight but which will cause the projectile to change shape immediately upon impact. The deforming means is preferably and economically used in combination with a core material which is a heavy material such as lead. It is within the scope of the invention to make the core itself entirely from shape-memory alloy. The core material can be unjacketed or fully or partially encased within a metal jacket. Several embodiments of the instant invention having deforming means of shape-memory alloy are discussed hereinafter at length.

Materials, both organic and metallic, possessing shape-memory, are well known. An article made from such materials can be deformed from an original, heat-stable configuration to a second, heat-unstable configuration. The article is said to have shape-memory for the reason that upon application of heat alone it can be caused to revert, or attempt to revert, from its heat unstable configuration to its original heat-stable configuration, i.e., it "remembers" its original shape. Metallic alloys of this type are hereinafter defined as shape-memory alloys.

Among the metallic alloys, the ability to display shape-memory is a result of the fact that the alloy undergoes a reversible transformation from an austenitic state to a martensitic state with a change in temperature. This transformation is sometimes referred to as a thermoelastic martensitic transformation. An article made from such an alloy is easily deformed from its original configuration to a new configuration when cooled to a temperature below which the alloy is transferred from the austenitic state to the martensitic state.

The temperature at which this transformation begins is usually referred to as $M_s$ and the temperature at which it finishes is $M_f$. When an article thus deformed is warmed to a temperature at which the alloy starts to revert back to austenite, referred to as $A_s$ ($A_f$ being the temperature at which the transformation is complete), the deformed object will begin to return to its original configuration. Also, the alloy is considerably stronger in its austenitic state than in its martensitic state. The deforming means of the instant invention may be fabricated from nickel-titanium shape-memory alloys which are well known to those skilled in the art, and, for example, are described in U.S. Pat. No. 3,351,463, which is incorporated herein by reference. Other literature describing the processing and characteristics of suitable compositions includes an article by Dr. William J. Buehler, the principal developer of the material, and William B. Cross, entitled "55 Nitinol-Unique Alloy Wire", which appeared in the June, 1969 issue of Wire Journal. A description of the materials and certain of the properties also may be found in the brochure entitled "Nitinol Characterization Studies" dated September, 1969. This document, identified as N-69-36367, or NASA CR-1433, is available from the Clearinghouse for Scientific and Technical Information, Springfield, Virginia, 22151. All of these publications are incorporated herein by reference. These binary shape-memory alloys are commercially available from a number of suppliers, one of which is Raychem Corporation in Menlo Park, California.

Other examples of shape-memory alloys are disclosed in U.S. Pat. Nos. 3,012,882, 3,174,851, 3,558,369, and 3,672,879, the disclosures of which are incorporated herein by reference. As made clear in these patents, these alloys undergo a transition between an austenitic state and a martensitic state at certain temperatures. When they are deformed while in the martensitic state, they will retain this deformation while maintaining this state but revert to their original configuration when they are heated to a temperature at which they transform to their austenitic state.

A significant part of the instant invention is the use of voids in the portions made of shape-memory alloy. This aspect of the invention is useful in all embodiments of the invention and in any device where extremely rapid recovery is desired.

Specifically, it is within the scope of the invention to utilize components of shape-memory alloy having voids therein. This may be accomplished by the known technique of powdered metallurgy wherein small particle grains of shape-memory alloy are held under temperature and pressure and, in essence, are sintered together. The desired porosity is accomplished by varying the size of the particles and the pressures applied. Other methods of creating voids are well known in the art, for example, the mixing of another material with the particles of shape-memory alloy to obtain the desired voids.

The provision of voids enhances the speed of recovery of the component. In the application of a projectile, or a deforming means for a projectile the voids are useful to rapidly generate heat upon impact due to the collapse of the voids being shocked.

A projectile transfers energy to the object it strikes by means of momentum transfer through shock waves. However, at impact a shock wave is also transmitted into the projectile. This shock wave in the projectile generates heat and pressure in the projectile. The instant invention utilizes the shock wave generated within the projectile to trigger the deforming means of shape-memory alloy. Specifically, the heat and pressure generated by the shock wave elevate the temperature of the alloy to the austenitic temperature discussed earlier. In several of the embodiments of the instant invention the deforming means of shape-memory alloy is located in the nose portion of the projectile. In these embodiments no shape change would occur during launch or flight. At impact, the heat and pressure associated with the shock wave in the projectile would cause the shape-memory alloy deforming means to alter the shape of the deforming means instantaneously and thus the shape of the projectile. It is within the scope of the invention to optimize the shape change for each type of projectile in order to provide improved impact energy transfer to the target. Shape changes such as diameter increase to increase resistance and point deformation to cause tumbling are examples.

The impact of a projectile upon a material has been studied experimentally and analytically at several centers, principally, the Material Technology Laboratory, the Ballistics Research Laboratory and Washington State University. Others include the Los Alamos National Laboratory and the Lawrence Livermore National Laboratory. A book which is incorporated herein by reference on the subject is "High Velocity Impact Phenomena", Academic Press, Inc., N.Y., (1970), edited by R. Kinslow, Library of Congress Catalog Card Number: 71-91425.

The above referenced book at pages 293–417 shows the connection between impact velocity and the pressure rise due to the impact shock wave in a material. A description of the calculation of the temperature rise due to a shock wave is given in this reference.

The following is a basic description understandable to a person skilled in the art of the method of calculating pressure and temperature rises due to impact shock waves. The description is meant to be illustrative. The previous reference gives data for most metals, common alloys, and some other materials, concerning the resultant pressure rises for that material for varying impact velocities. The data is presented numerically. The locus of single shock states with varying shock strengths is called the Hugoniot.

To obtain the shock wave pressure for a projectile impacting an object, first the Hugoniot curve for the projectile is reflected (mirror image) and then both of the reflected projectile Hugoniot and the object Hugoniot are located in the pressure/projectile velocity plane. The intersection of the reflected projectile Hugoniot with the object Hugoniot gives the pressure and particle velocity upon impact. This calculation is based on the fact that the pressure and particle velocity of both projectile and object are identical at the impact interface.

The previous reference shows how, and gives the data, to calculate the temperature and pressure rises that will occur in the material of a projectile impacting another material, at a known velocity. The impact pressure depends on the projectile material. The material being struck, and the impact velocity of the projectile. For the purpose of this patent the following discussion concerns only a projectile impacting soft material, animal tissue, plastics, etc. The results can be divided into two groups; the first is when the projectile impact velocity is high, above 2 km/s, and the second when the projectile impact velocity is below 1 km/s. In the projectile velocity range between 1 and 2 km/s the results are dependent on the materials of the projectile and the object being struck.

Generally, for the first group, when a metal projectile has an impact velocity greater than 2 km/s, the impact shock wave will be strong enough the produce pressure rises on the order of 50 to 100 kbar and temperature increases on the order of 20 to 50 degrees C. The exact increases depend on the materials of the projectile and the object being struck. The previous reference describes the methods and gives data to allow the pressure and temperature rises to be calculated for this first group. A basic premise in those calculations is that the projectile material is high-density, void free metal. The pressure and temperature rises for the first group will probably be sufficient to trigger the shape change in shape-memory-alloy.

The pressure and temperature rises for the second group will be much less, and are not expected to be sufficient to trigger the shape change in the shape-memory-alloy, unless further design is done to enhance those rises. For example, a copper projectile impacting high-density (0.95) polyethelene at 1 km/s will have about a 36 kbar pressure rise and about a 15 degree C. temperature rise. Those rises would probably be insufficient to trigger the shape change in shape-memory-alloy pieces in such a projectile. Projectiles of other high-density metals would have pressure and temperature rises similar to those for copper, because these metals have only a few percent compression at low impact velocities, especially when impacting soft material. Most rifle and pistol bullets have velocities in this range, below 1 km/s.

A method which allows temperature increase in the projectile to be increased for a given impact velocity is to decrease the density of the material of the projectile, that is to increase the voids in the metal. The reason this increases the temperature rise is that the voids collapse under the impact shock wave. That greatly increases the plastic work done, and that in turn causes more heat to be generated in the metal. For the example used previously, changing only from no voids in the copper to 10% voids in the copper metal, the temperature rise due to the impact shock wave increases to about 62 degrees C.

As discussed earlier, there are several methods to create voids in metals. One which allows a precise control of the amount of void in the metal is to start with metal powder that has a known particle size and hot press the powder to form a piece having the desired void content.

In general summary, the instant invention provides a piece of shape-memory alloy in the nose of the projectile wherein no shape change would occur during launch or flight. At impact the temperature rise due to the shock wave in the projectile would cause the shape-memory alloy piece to change shape. The shape change would be optimized for each type of projectile in order to provide improved impact energy transfer to the target. Shape changes such as diameter increase to increase resistance, and point deformation to cause tumbling are examples.

Published data concerned with impact mechanics, such as the previous reference, point out that the impact shock wave attenuates as it travels from the point of impact along the length of the projectile. No shock wave should be expected beyond one projectile diameter back from the nose portion, or point of impact. The majority of projectiles are cylindrical so that the front center is the projectile nose, and the intended point of impact. Therefore, all designs shown hereinbelow concentrate on having the deforming means of shape-memory alloy at the front center of the projectile. It is within the scope of the invention however to locate the deforming means at other locations within a projectile to perform a desired projectile shape change.

With continued reference to the drawing, FIG. 1 illustrates a generic projectile shown generally at 10, preferably comprising a core 12 and a deforming means 14. "Generic" projectile configurations are illustrated and described through the specifications but it is understood that the instant invention is applicable to a myriad of geometric configurations well known to those skilled in the art. The projectile 10 is shown to be of conventional design having a core 12 of heavy metal such as lead which is optionally but conventionally encased within a jacket 16.

The deforming means is formed of a shape-memory alloy and the deforming means is in operative contact with the core. In this embodiment the deforming means is contained within the core wherein the core has a longitudinal axis and the deforming means comprises a generally cylindrically shaped rod that is in general axial alignment with the axis.

The shape-memory alloy has a martensitic state and an austenitic state and the deforming means is capable of being dimensionally deformed while the alloy is in its martensitic state into the cylindrically-shaped rod shown in the Figure. While in its martensitic state prior to impact of the projectile the alloy remains in its martensitic state and the deforming means 14 remains in column contained within the core.

Figure 2:
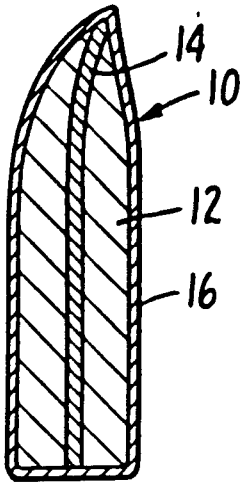
FIG. 2 is a view similar to FIG. 1 of the projectile after impact after having developed a curve along the cylindrical body of the projectile.

FIG. 2 illustrates the projectile 10 after impact, i.e., after the temperature rise due to the impact shock wave has triggered the phase transition in the shape-memory alloy from its martensitic state to its austenitic state. As seen in FIG. 2, the deforming means 14 is capable of recovering upon impact to its non-deformed dimension that of a bent or out-of-column rod. It can be seen that the out-of-column deforming means 14 is capable of altering the geometric shape of the core 12 which will cause the projectile to tumble and therefore improve the impact energy transfer of the projectile.

The projectile 10 has thus been shown before impact in FIG. 1 in the smooth and symmetric shape required for launch and flight. In FIG. 2 the projectile is shown after impact, after the temperature rise due to the impact shock wave has triggered the phase transition in the shape-memory alloy which then, in turn, deforms the projectile into a curved shape causing the projectile to tumble after impact.

Figure 3:
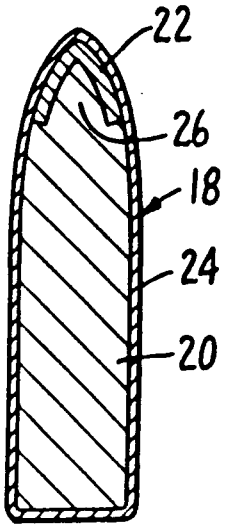
FIG. 3 is a full section view similar to FIG. 1 of a second embodiment of the invention before impact of the projectile.

FIG. 3 illustrates a second embodiment of a generic projectile 18 having a core 20 and a deforming means 22 of shape-memory alloy in operative contact with the core 20. The projectile 18 is further provided with an optional skin 24.

In this embodiment, the core 20 again has a longitudinal axis and includes a nose portion 26 and the deforming means 22 comprises a cap that is complementary to and in contact with the nose portion 26. It can be seen from the figure that the cap is symmetrical about the axis of the core with respect to the nose portion. The deforming means 22 is actually dimensionally deformed while in its martensitic state into this symmetrical configuration, a change from its martensitic state to its austenitic state being capable of recovering the deforming means upon impact to its non-deformed dimension which is illustrated in FIG. 4 wherein the cap is capable of being asymmetrical about the axis with respect to the nose portion.

Figure 4:
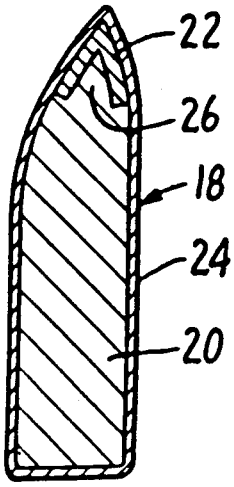
FIG. 4 is a view similar to FIG. 3 of the projectile after impact after having developed an off-center point.

FIGS. 3 and 4 therefore show a projectile 18 that before impact is in the smooth and symmetric shape required for launch and flight. The projectile is shown in FIG. 4 after impact, after the temperature rise due to the impact shock wave has triggered the phase transition in the shape-memory alloy and which then has deformed the nose portion 26 such that the point of the nose is not along the longitudinal axis of the core or of the projectile. That altered shape will cause the projectile to tumble after impact.

Figure 5:
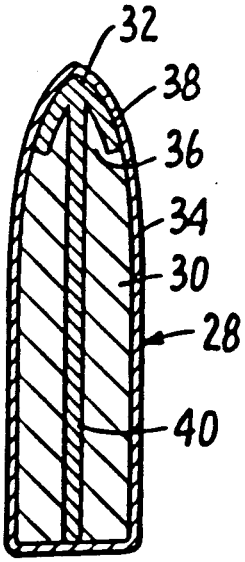
FIG. 5 is a full section view of a third embodiment of the invention before impact.

FIG. 5 illustrates a third embodiment of the instant invention wherein a generic projectile shown generally at 28 comprises a core 30 and deforming means 32. Again, the core and deforming means may be covered by an optional skin 34. In this embodiment the core 30 again has a longitudinal axis and includes a nose portion 36 and the deforming means 32 comprises a cap 38 that is complementary to and in contact with the nose portion and further includes a generally cylindrically shaped rod 40 that is in general axial alignment with said axis.

Figure 6:
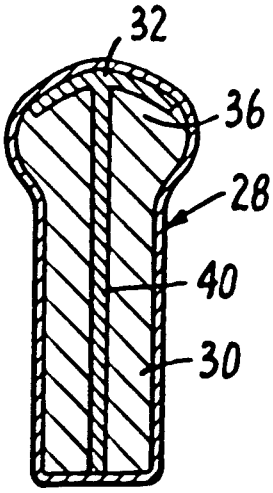
FIG. 6 is a view similar to FIG. 5 of the projectile after impact after having developed an enlarged diameter.

In this embodiment, the rod 40 of the deforming means 32 is deformed by lengthening the rod while the alloy of the deforming means is in its martensitic state. The deformed condition of the rod 40 is illustrated in FIG. 5. Upon impact and phase change of the alloy from its martensitic state to its austenitic state the rod 40 recovers and reduces in length to its original non-deformed dimension as seen in FIG. 6.

With reference to FIG. 5 the projectile 28 is shown before impact in the smooth and symmetric shape required for launch and flight. In FIG. 6 the projectile is shown after impact, after the temperature rise due to the impact shock wave has triggered the phase transformation in the shape-memory alloy of the deforming means which then broadened the nose portion 36 and pulled the nose portion closer to the projectile base, which has, in turn, forced the core 30 to flow radially outward, thus causing the projectile diameter to increase. The altered shape of FIG. 6 improves the impact energy transfer of the projectile.

All of the aforementioned projectiles have been illustrated as having a generic projectile shape and as having a core of malleable metal as well as an optional skin. It is understood that it is within the scope of the invention to form the projectile into other known projectile configurations with or without a skin and further, to form a projectile wherein the deforming means comprises the core with or without a skin, i.e., where the entire projectile is made from shape-memory alloy.

Figure 7:
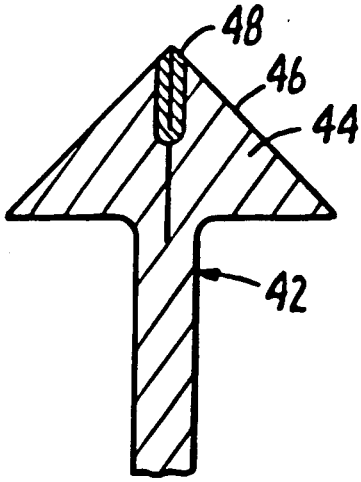
FIG. 7 is a full section view of the forward portion of a fourth embodiment of the invention, a generic cutting projectile, before impact of the projectile.
Figure 8:
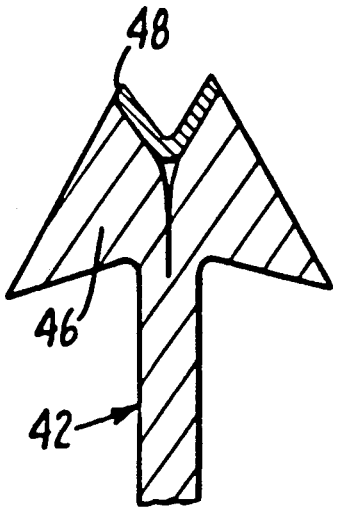
FIG. 8 is a view similar to FIG. 7 after impact of the projectile after the cutting cross-section of the projectile is enlarged.

FIG. 7 illustrates a further embodiment of the instant invention wherein a generic cutting projectile shown generally at 42 having a core 44 having a longitudinal axis and including a cutting head 46. The projectile 42 includes a deforming means 48 that is contained within the cutting head and in general axial alignment with the axis. A change of the alloy of the deforming means from its deformed martensitic state as seen in FIG. 7 to its austenitic state as seen in FIG. 8 being capable of radially expanded the cutting head 46 with respect to the axis, increasing the cross-section of the cutting head.

FIG. 7 therefore shows the projectile before impact in the smooth and symmetric shape again required for launch and flight. In FIG. 8 the projectile is shown after impact, after the temperature rise due to the impact shock wave has triggered the phase transition in the shape-memory alloy of the deforming means which has then separated the cutting head of the projectile into two or more sections which open outward at the point of the projectile, both increasing the projectile's cross-section and exposing more cutting edge. The expanded shape will cause the projectile to have increased lethality after impact.

Figure 9:
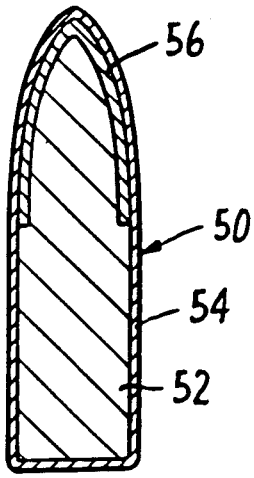
FIG. 9 is a full section view of a fifth embodiment of the instant invention, a generic armor-piercing projectile prior to impact of the projectile.

FIG. 9 illustrates a fifth embodiment of the instant invention wherein an armor-penetrating projectile shown generally at 50 comprises a core 52, a skin 54 surrounding the core 52 and a deforming means 56 positioned between the core 52 and the skin 54. In this embodiment, the core 52 has a longitudinal axis and the deforming means 56 has been radially expanded while the alloy is in its martensitic state to the configuration illustrated in FIG. 9. Upon impact, the deforming means goes through transition from its martensitic state to its austenitic state and is capable of radially compressing the core 52 about the longitudinal axis to improve the armor penetration characteristics of the projectile.

Figure 10:
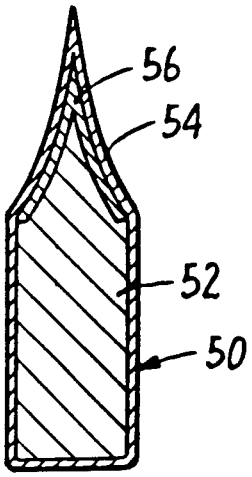
FIG. 10 is a view similar to FIG. 9 after impact of the projectile after the decrease in the diameter of the forward portion of the projectile.

FIG. 9 thus illustrates the projectile before impact in the smooth and symmetric shape required for launch and flight. FIG. 10 illustrates the projectile after impact, after the temperature rise due to the impact shock wave has triggered the phase transition in the shape-memory alloy wherein the deforming means 56 has recovered to a reduced diameter at the front of the projectile to improve the armor-penetration characteristics of the projectile.

Figure 11:
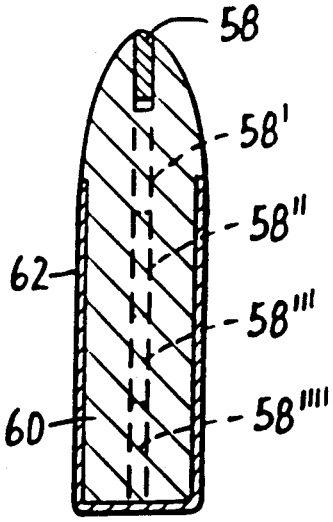
FIG. 11 is a full section view of a sixth embodiment of the instant invention, a generic soft-nosed projectile, prior to impact of the projectile.
Figure 12:
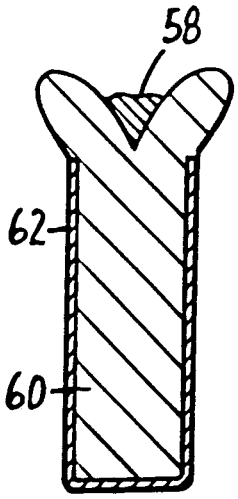
FIG. 12 is a view similar to FIG. 11 after impact of the projectile after the soft nose portion of the projectile has been expanded.

FIGS. 11 and 12 illustrate a generic soft nosed projectile wherein the deforming means 58 is positioned in the nose of the core 60. The core 60 is preferably partially jacketed by skin 62. As seen in FIG. 12, upon impact the core 60 is "mushroomed" out by the deforming means 58 which recovers to a larger diameter as it is driven deeper within the core 60 by the impact.

FIG. 11 also illustrates another aspect of the invention which is applicable to all embodiments of the invention. Multiple elements 58', 58'', 58''', and 58'''' are shown in phantom. These elements are also of shape-memory alloy. The elements may be made from different shape-memory alloys, may have different degrees of recovery and may have different void contents-all to improve projectile energy transfer.

Figure 13:
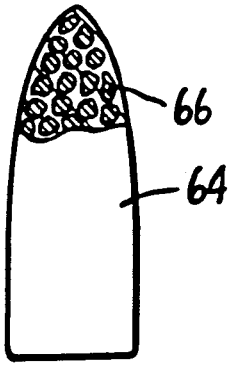
FIG. 13 is a partial cross-sectional view of a projectile before impact made entirely of shape-memory alloy and further where the projectile may contain voids to enhance recovery of the projectile.

FIG. 13 illustrates the general concept of making the entire projectile 64 from shape-memory alloy as described earlier herein. This figure also illustrates the concept of fabricating the projectile 64 from shape-memory alloy material containing voids. It is understood that any of the embodiments discussed heretofore may also be fabricated from shape-memory alloy containing voids.

While the preferred embodiments of the present invention have been described, it should be understood that various changes, adaptations and modifications may be made therein without departing from the spirit of the invention and the scope of the appended claims.

What is claimed is:

1. A projectile, comprising:

a core; and deforming means of shape-memory alloy in operative contact with said core, said deforming means altering the geometric shape of said core upon impact of the projectile due to shape-memory effect to improve the impact energy transfer of the projectile.

2. A projectile as in claim 1 wherein said shape-memory alloy has a martensitic state and an austenitic state, said deforming means being dimensionally deformed prior to impact while said shape-memory alloy is in its martensitic state, a change from its martensitic state to its austenitic state recovering said deforming means upon impact to its non-deformed dimension to alter the geometric shape of said core.

3. A projectile as in claim 2 wherein said deforming means is generally contained within said core.

4. A projectile as in claim 3 wherein said core has a longitudinal axis, said deforming means comprising a rod that is dimensionally deformed into general axial alignment with said longitudinal axis when said shape-memory alloy is in its martensitic state, said rod recovering to be out of column when said shape-memory alloy is in its austenitic state.

5. A projectile as in claim 2 wherein said core has a longitudinal axis and includes a nose portion and said deforming means comprises a cap that is complementary to and in contact with said nose portion, said cap being symmetrical about said longitudinal axis with respect to said nose portion when said shape-memory alloy is in its martensitic state, said cap being asymmetrical about said longitudinal axis with respect to said nose portion when said shape-memory alloy is in its austenitic state.

6. A projectile as in claim 2 wherein said core has a longitudinal axis and includes a nose portion and said deforming means comprises a cap that is complementary to and in contact with said nose portion, said deforming means further including a rod in general axial alignment with said longitudinal axis and having a first length, when said shape-memory alloy is in its martensitic state, said rod reducing in length when in its austenitic state.

7. A projectile as in claim 2 wherein said core has a longitudinal axis and includes a cutting head, said deforming means being contained within said cutting head and being in general axial alignment with said longitudinal axis, a change of said shape-memory alloy from its martensitic to its austenitic state radially expanding said cutting head with respect to said longitudinal axis, increasing the cross-section of the cutting head.

8. A projectile as in claim 2 wherein said core has a longitudinal axis and further including a skin surrounding said core, said deforming means being positioned between said core and said skin, a change in said shape-memory alloy from its martensitic to its austenitic state radially compressing said core about said longitudinal axis to improve armor penetration characteristics of the projectile.

9. A projectile as in claim 2 wherein said deforming means contains voids, said voids enhancing the recovery of said deforming means beyond the inherent recovery of the shape-memory alloy comprising said core if said voids were not present.

10. A projectile of shape-memory alloy wherein said shape-memory alloy has a martensitic state and an austenitic state, said projectile being dimensionally deformed prior to impact while said shape-memory alloy is in its martensitic state, a change from its martensitic state to its austenitic state recovering said projectile upon impact due to shape-memory effect to its non-deformed dimension to alter the geometric shape of the projectile to improve the impact energy transfer of the projectile.

11. A projectile as in claim 10 wherein said projectile contains voids and said voids enhancing the recovery of said projectile beyond the inherent recovery of the shape-memory alloy comprising said projectile if said voids were not present.

12. A projectile, comprising:

a core having a longitudinal axis; and deforming means of shape-memory alloy being in operative contact with said core and being generally contained within said core, said shape-memory alloy having a martensitic state and an austenitic state, said deforming means comprising a rod that is dimensionally deformed prior to impact into general axial alignment with said longitudinal axis when said shape-memory alloy is in its martensitic state, a change from its martensitic state to its austenitic state recovering said rod upon impact to its non-deformed dimension to be out of column to alter the geometric shape of said core due to shape-memory effect to improve the impact energy transfer of the projectile.

13. A projectile, comprising:

a core having a longitudinal axis and including a cutting head; and deforming means of shape-memory alloy being in operative contact with said core and being contained within said cutting head and being in general axial alignment with said longitudinal axis, said shape-memory alloy having a martensitic state and an austenitic state, said deforming means being dimensionally deformed prior to impact while said shape-memory alloy is in its martensitic state, a change from its martensitic state to its austenitic state recovering said deforming means upon impact to its non-deformed dimension, radially expanding said cutting head with respect to said longitudinal axis due to shape-memory effect, increasing the cross-section of the cutting head to improve the impact energy transfer of the projectile.

* * * * *

UNITED STATES PATENT AND TRADEMARK OFFICE

CERTIFICATE OF CORRECTION

PATENT NO. : 4,704,968

DATED : November 10, 1987

INVENTOR(S) : Thomas O. Davis, Jr.

It is certified that error appears in the above—identified patent and that said Letters Patent is hereby corrected as shown below:

Column 5, line 10, ". The" should be --, the--.

Column 8, line 4, "further" should be --fourth--.

Column 10, line 10, "core" should be --deforming means--.

Signed and Sealed this

Thirtieth Day of August, 1988

*Attest:*

DONALD J. QUIGG

*Attesting Officer*

*Commissioner of Patents and Trademarks*